US006865762B2

(12) United States Patent
Hollingsworth

(10) Patent No.: US 6,865,762 B2
(45) Date of Patent: Mar. 15, 2005

(54) METHOD FOR CLEANING CARPET AND OTHER SURFACES

(76) Inventor: Paul K. Hollingsworth, 238 Concho Dr., Henderson, NV (US) 89015

( * ) Notice: Subject to any disclaimer, the term of this patent is extended or adjusted under 35 U.S.C. 154(b) by 360 days.

(21) Appl. No.: 10/067,474

(22) Filed: Feb. 4, 2002

(65) Prior Publication Data

US 2003/0145391 A1 Aug. 7, 2003

(51) Int. Cl.[7] ..... D06B 1/02
(52) U.S. Cl. ..... 8/148; 8/158; 68/5 A
(58) Field of Search ..... 8/147, 148, 158; 68/5 A, 5 B, 13 R, 200, 205 R

(56) References Cited

U.S. PATENT DOCUMENTS

| | | | | |
|---|---|---|---|---|
| 1,428,807 A | * | 9/1922 | Rose | 401/282 |
| 3,122,508 A | | 2/1964 | Grifo et al. | |
| 3,591,510 A | | 7/1971 | Zenk | |
| 3,801,274 A | * | 4/1974 | Gleason | 8/142 |
| 3,887,392 A | * | 6/1975 | Tang | 134/1 |
| 4,219,333 A | | 8/1980 | Harris | |
| 4,767,034 A | * | 8/1988 | Cramer | 222/525 |
| 5,035,871 A | | 7/1991 | Sikorski et al. | |
| 5,086,723 A | * | 2/1992 | Goldbach et al. | 114/78 |
| 5,624,465 A | | 4/1997 | Harris | |
| 5,858,299 A | | 1/1999 | Fernholz et al. | |
| 5,888,953 A | | 3/1999 | Harris et al. | |
| 6,233,771 B1 | * | 5/2001 | Hortel et al. | 8/150 |
| 6,287,346 B1 | * | 9/2001 | Ofosu-Asante et al. | 8/103 |

FOREIGN PATENT DOCUMENTS

| | | |
|---|---|---|
| JP | 50-70684 | * 11/1973 |
| JP | 9-268473 | * 10/1997 |
| WO | WO 02/079363 | * 10/2002 |

OTHER PUBLICATIONS

The Pilsbury Company, Hungry Jack Regular Syrup Label.

* cited by examiner

*Primary Examiner*—Frankie L. Stinson
(74) *Attorney, Agent, or Firm*—Stetina, Brunda, Garred & Brucker

(57) ABSTRACT

A method for cleaning a soiled textile product by using a heated cleaning composition. The method includes providing a hand-holdable single vessel with a hand-operable dispenser and a single aqueous non-effervescent cleaning composition within the vessel. The vessel bearing the cleaning composition is placed into a microwave oven and heated for a specified time period to be about 90–160 degrees F., whereupon a quantity of the cleaning composition is dispensed via spraying on the soiled area. Finally, the treated area is blotted by hand with a fibrous towel for removal of cleaning composition and soil.

2 Claims, 1 Drawing Sheet

METHOD FOR CLEANING CARPET AND OTHER SURFACES

CROSS-REFERENCE TO RELATED APPLICATIONS (Not Applicable)

STATEMENT RE: FEDERALLY SPONSORED RESEARCH/DEVELOPMENT (Not Applicable)

BACKGROUND OF THE INVENTION

The present invention is related in general to carpet and other surface cleaning, and in particular to a method for hand cleaning a textile product through hand-dispensing, from a hand-holdable single vessel, a single, aqueous, previously microwave-heated, non-effervescent cleaning composition on a soiled area to be cleaned and thereafter blotting the soiled area by hand with a fibrous towel.

Scientists, home economists, and others are constantly striving for more effective cleaning products and methods to help the consumer save time and energy while cleaning. In addition to being effective, the cleaning products and methods must not be substantially harmful to the consumer.

The cleaning of carpet, upholstery, and other fabrics and/or surfaces is often troublesome and consumers must often resort to professional cleanings. Professional cleanings, however, must be scheduled, can become quite expensive, and are inconvenient. Moreover, it is well known that the likelihood of removing a spot substantially increases if promptly treated. Practically speaking, professional cleanings are therefore not available on a daily basis for everyday spills and spots.

In recognition of these problems, there have been several cleaning products developed for the consumer to clean carpet, upholstery, and other fabrics. Certain of these products as well as others have been especially developed for spot cleaning. Unfortunately, these products can often exacerbate a stain, particularly if they leave an invisible soapy film that dirt and dust later cling to. Furthermore, some of these products are just not effective against stubborn stains. For example, pet stains are notoriously resistant to treatment.

Generally speaking, when cleaning a carpet or textile fabric, there are four factors which are used either alone or in conjunction with one another to achieve desired cleaning results. One factor is the use of a chemical composition. Another factor is dwell time, i.e., the time a chemical composition is allowed to reside on the carpet to treat the soiled area of the carpet or textile fabric. Agitation, such as the action of blotting or scrubbing, is a third factor. Finally, the fourth and often overlooked factor is heat. In this regard, a cleaning chemical composition typically is more effective in cleaning soiled carpets and textiles if the cleaning composition is elevated in temperature. To date, heat has been the primary cleaning factor that has been overlooked and missing from carpet and textile cleaners available to consumers.

Accordingly, there has been a need for a novel cleaning chemical composition for general and spot cleaning having improved effectiveness by incorporating heat during application and a unique method for applying the same which can easily, safely, and effectively be used by a consumer for cleaning carpet, upholstery, fabric and other surfaces. Such a cleaning chemical composition and method are needed which can be used on substantially any spot or stain, including pet stains. Further, such a cleaning chemical composition and method are needed which do not leave a soapy residue to exacerbate the spot or stain. The present invention fulfills these needs and provides other related advantages.

BRIEF SUMMARY OF THE INVENTION

The present invention comprises an apparatus and method for cleaning a soiled area of a surface such as a textile product, and first includes the provision of a hand-holdable single vessel with a hand-operable dispenser for dispensing a liquid from within the vessel. Next, a single aqueous non-effervescent cleaning composition comprising a ratio of a quantity of at least one cleaning chemical to a quantity of water of from about 1/16 to 8 cups cleaning composition to five gallons of water is prepared and placed within the vessel. Third, the vessel with the cleaning composition therein is placed into a microwave oven and heated to a temperature of between about 90 degrees F. and about 160 degrees F., whereupon the vessel is removed from the microwave oven and a quantity of the single aqueous non-effervescent cleaning composition therein is substantially immediately applied by hand using the vessel dispenser on the soiled area to be cleaned. Finally, the soiled area so treated is blotted by hand with a fibrous towel for removal of composition and soil from the textile product.

Preferably, the at least one cleaning chemical is sodium tripolyphosphate, however other chemical cleaners are contemplated herein. With respect to the vessel, it preferably has a height dimension of about six inches such that it is easily hand-holdable and that it readily fits in an upright orientation within a typical residential microwave oven compartment. The hand-operable dispenser preferably is a spray apparatus leading from an opening of the vessel, thereby permitting the cleaning composition to be easily applied by hand operation of the spray apparatus for directed application to the soiled textile area.

BRIEF DESCRIPTION OF THE DRAWINGS

An illustrative and presently preferred embodiment of the invention is shown in the accompanying drawings in which.

DETAILED DESCRIPTION OF THE INVENTION

Figure 1:
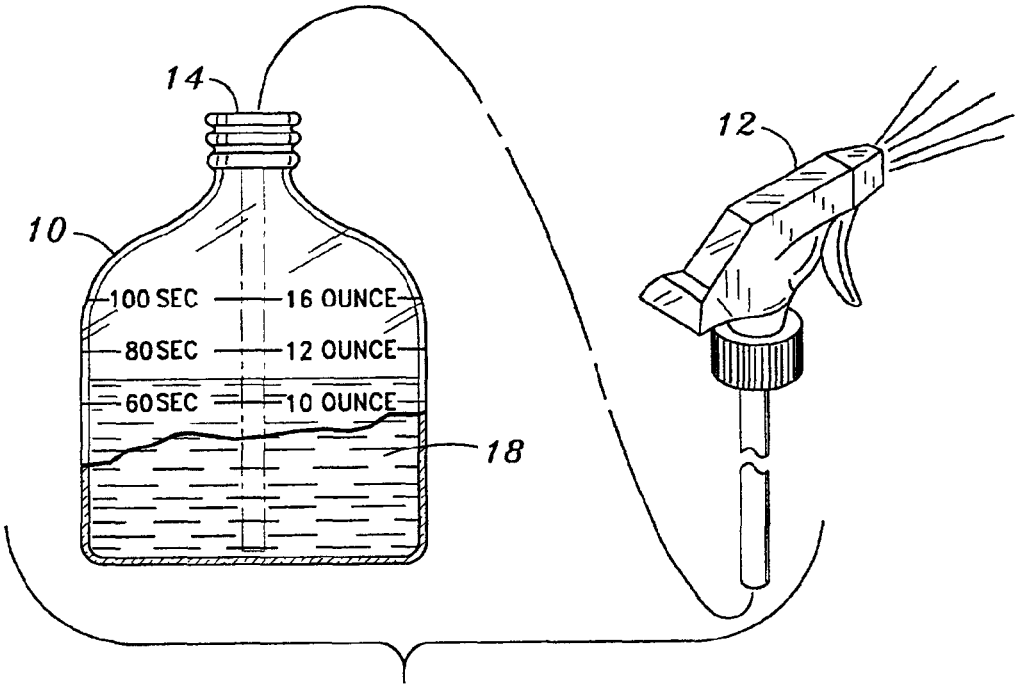
FIG. 1 is an exploded perspective view of a vessel containing a cleaning composition with the sprayer dispenser removed.
Figure 2:
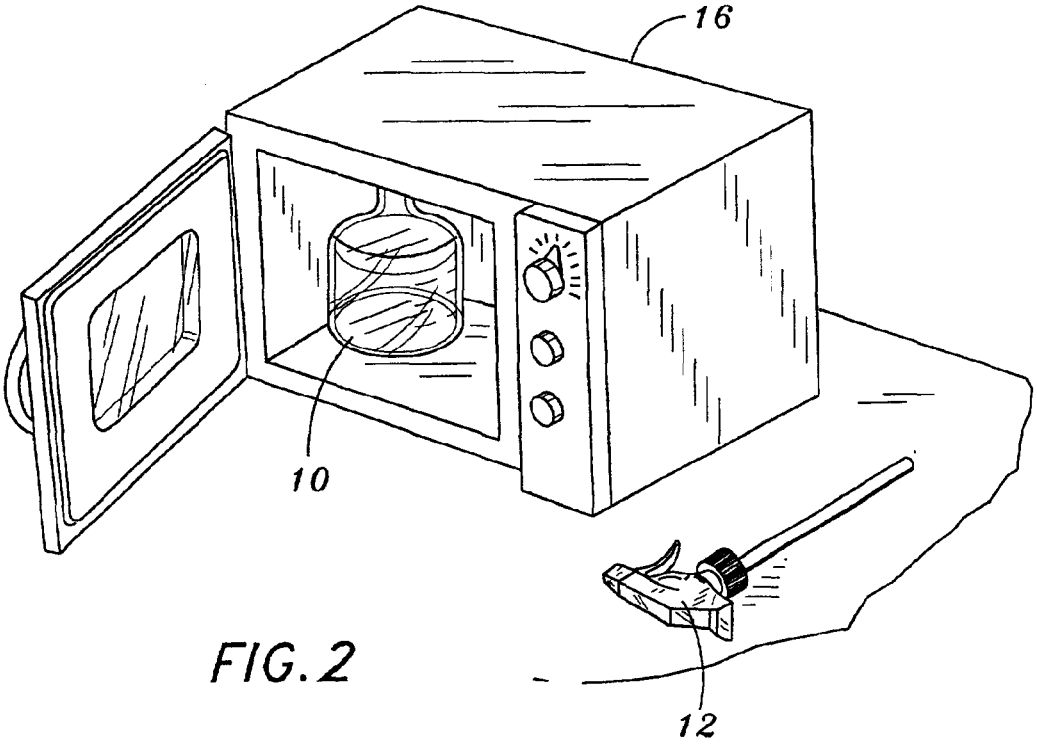
FIG. 2 is a perspective view of an open microwave oven within which the vessel of FIG. 1 is placed with the sprayer dispenser removed.

Referring to FIGS. 1 and 2, a vessel 10, hereby exemplified as a transparent graduated container having plural numeral designations of "10-," "12-," and "16-ounce" printed graduations thereon, as well as corresponding microwave heating time graduations such as 60, 80 and 100 seconds printed thereon, which heating times are commensurate with the particular cleaning composition and volume to raise the temperature of the solution volume to desired application ranges. The container 10 is shown in exploded form to demonstrate the screw top attachment of a hand-operable dispenser 12, here exemplified as a conventional trigger-spray apparatus, at a top opening 14 of the vessel 10. The vessel 10 and dispenser 12 typically are constructed of a plastic capable of withstanding at least about 160 degrees F. without deformation, and the vessel 10 is no greater than about six inches tall to thereby assure upright placement within the compartment of a conventional residential microwave oven 16 as shown in FIG. 2.

Within the vessel 10 is a single aqueous non-effervescent cleaning composition 18 comprising a ratio of a quantity of at least one cleaning chemical to a quantity of water preferably from about 1/16 cup to 8 cups cleaning chemical to about five gallons of water. While more than one cleaning chemical or fragrance can be incorporated into the cleaning composition so long as all cleaning chemicals are compatible, the preferable and sole cleaning chemical is sodium tripolyphosphate.

To accomplish the cleaning of a soiled area of a textile product such as carpet or upholstery, a user places the composition-bearing vessel 10 (without the dispenser 12 in place) in the microwave oven 16 and heats the composition 18 to a temperature between about 90 and 160 degrees F., a temperature at which the composition 18 (as well as the vessel 10) feels warm to the touch. The particular microwave heating time is easily facilitated by the plural time graduations formed on the vessel 10. Thereafter, the vessel is removed from the microwave oven 16, the dispenser 12 is attached, and a quantity of the single aqueous non-effervescent cleaning composition 18 is substantially immediately applied by hand through the dispenser 12 onto the soiled area of the textile product (not shown) to be cleaned. Finally, the soiled area so treated is blotted by hand with a standard fibrous towel (not shown) for removal of composition and soil from the textile product.

In using the cleaning composition on upholstery or textiles, a manufacturer's cleanability code tag should first be consulted if possible. If the fabric is coded "WS" or "W", use is appropriate. If the fabric is coded "X" or "S" or is velvet, silk, or leather, use is inappropriate. One must also consider that some fabrics require the use of foam or dry cleaning products. If suitable for the particular carpet, upholstery, or fabric, a hidden area should then be tested for colorfastness by conventional methods. If the color is not affected, the cleaning composition may be used. If the spot is dry, the spot should first be vacuumed to remove excess debris. The cleaning composition may then be applied to the spot, preferably by spraying. A clean, white terry cloth towel should then be used to wipe up the spot. Spraying and wiping may be repeated as needed. When cleaning a spot from upholstery, the towel should first be spray-dampened with the cleaning compound and then the damp towel can be used to gently rub the spot out of the upholstery.

If the stain remains resistant, a conventional enzyme cleaner may also be used on the spot. It is not necessary that the previous cleaning composition be dry on the carpet/fabric before using the enzyme cleaner. The enzyme cleaner should remain (i.e., dwell time) on the spot for up to about five minutes to allow the enzymes to break down soils and digest any proteins. The enzyme cleaner should then be wiped up with a clean, white terry cloth towel. After the enzyme cleaner has dried on the soiled area of the textile (usually by the next day), the soiled area should be rinsed again with clean water, the cleaning composition applied, and the treated area wiped up again. This treatment should substantially remove or lessen the spot or stain; however, some stains or soiling will cause permanent discoloration even after cleaning.

In preparing the cleaning composition, the microwave should not be left unattended. The cleaning composition should be left in the microwave until the vessel 10 can be handled safely. Children should not use the composition without adult supervision. The composition should not be mixed with bleach, or used with any incompatible product that could harm the textile product being cleaned.

As is apparent, the methodology here defined permits a user to effectively clean a soiled textile product by providing a heated, and therefore, more effective, cleaning composition and cleaning-composition application while accomplishing such maintenance with a hand-holdable single vessel and a single, aqueous, non-effervescent, cleaning composition.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. A method for cleaning a soiled area of a textile product, the method comprising:

a) providing a hand-holdable single vessel with a hand-operable dispenser for dispensing a liquid from within the vessel;

b) preparing and placing within the vessel a single aqueous non-effervescent cleaning composition comprising a ratio of 1/16 cup to 8 cups cleaning chemical to a quantity of 5 gallons of water;

c) placing the vessel with said cleaning composition therein into a microwave oven and heating said composition to a temperature of between about 90 degrees F. and about 160 degrees F.;

d) removing the vessel from the microwave oven and substantially immediately applying by hand from said vessel by using the dispenser, a quantity of so-heated said single aqueous non-effervescent cleaning composition onto the soiled area to be cleaned; and e) blotting said soiled area with a fibrous towel.

2. A method for cleaning a soiled area of a product, the method comprising:

a) providing a hand-holdable single vessel with a spayer dispenser for dispensing a liquid from within the vessel;

b) preparing and placing within the vessel an aqueous cleaning composition;

c) placing the vessel with said cleaning composition therein into a microwave oven and heating said composition to a temperature of between about 90 degrees F. and about 160 degrees F.;

d) removing the vessel from the microwave oven and substantially immediately applying by hand from said vessel by using the dispenser, a quantity of said composition onto the soiled area to be cleaned; and e) blotting said soiled area with a towel.

* * * * *